US005576506A

United States Patent [19]

Kawashima et al.

[11] Patent Number: 5,576,506

[45] Date of Patent: Nov. 19, 1996

[54] DEVICE FOR EDITING AUTOMATIC PERFORMANCE DATA IN RESPONSE TO INPUTTED CONTROL DATA

[75] Inventors: Susumu Kawashima; Masao Kondo, both of Hamamatsu, Japan

[73] Assignee: Yamaha Corporation, Hamamatsu, Japan

[21] Appl. No.: 396,074

[22] Filed: Feb. 28, 1995

Related U.S. Application Data

[63] Continuation of Ser. No. 910,648, Jul. 8, 1992, abandoned.

[30] Foreign Application Priority Data

Jul. 9, 1991 [JP] Japan ..... 3-168511

[51] Int. Cl.[6] ..... G10H 7/00

[52] U.S. Cl. ..... 84/602; 84/633

[58] Field of Search ..... 84/602, 609, 610, 84/633, 634, 649, 650, 665

[56] References Cited

U.S. PATENT DOCUMENTS

| | | | |
|---|---|---|---|
| 4,768,413 | 9/1988 | Fujimori | 84/DIG. 12 X |
| 4,930,390 | 6/1990 | Kellogg et al. | 84/611 |
| 4,953,438 | 9/1990 | Shibukawa | 84/609 |
| 5,220,119 | 6/1993 | Shimada | 84/609 |
| 5,225,618 | 7/1993 | Wadhams | 84/602 |
| 5,229,533 | 7/1993 | Sakurai | 84/618 |
| 5,241,125 | 8/1993 | Miyamoto | 84/609 |
| 5,270,477 | 12/1993 | Kawashima | 84/622 |
| 5,290,967 | 3/1994 | Shimaya | 84/633 |
| 5,313,012 | 5/1994 | Ishida | 84/609 |

FOREIGN PATENT DOCUMENTS 61-151898 7/1987 Japan .

*Primary Examiner*—Jonathan Wysocki
*Assistant Examiner*—Jeffrey W. Donels
*Attorney, Agent, or Firm*—Loeb & Loeb LLP

[57] ABSTRACT

An automatic performance data editing device has a memory device, an Input device and control device. The memory device stores performance data used for carrying out. The performance data includes control data which control the automatic performance. The input device can provide a control data while carrying out the automatic performance. The control device edits the performance data stored in the memory device in such a manner that, when a control data is provided by the panel switches, a control data which has been read out from the memory device to control the automatic performance is updated by the provided control data.

8 Claims, 11 Drawing Sheets

DEVICE FOR EDITING AUTOMATIC PERFORMANCE DATA IN RESPONSE TO INPUTTED CONTROL DATA

This is a continuation of application Ser. No. 07/910,648, filed Jul. 8, 1992, now abandoned.

BACKGROUND OF THE INVENTION

The present invention relates to automatic performance data edit devices for editing automatic performance data which are used for controlling the automatic performance of electronic musical instruments.

This kind of device has a memory for storing the automatic performance data. The automatic performance data includes note data, which controls the generation of a musical tone, and control data such as tone color data, which designate the tone color of a musical tone to be generated, and volume data, which designate the tone volume. Users can write desired performance data in the memory by operating the input device of the performance data edit device.

There are cases in which the user wishes to update the performance data which have been previously stored in the memory. In these cases, the user should perform the following operations:

(1) The user should change the operational function mode of the device to an edit mode.

(2) The user should discover which performance data is to be updated from among the all performance data in the memory.

(3) Once the performance data to be updated is discovered, the user should input the desired performance data in place of this discovered performance data.

For example, suppose that memory stores the performance data which present a performance in which the tone colors of the generated musical tones sequentially vary, for example as tone color A→tone color B→tone color C. If the user wishes to replace tone color C by tone color D, the user should discover the tone color data of tone color C from the all performance data and, after which, the user should replace the tone color data of tone color C by that of tone color D. In this manner, however, troublesome operations are necessary to replace the performance data. Furthermore, the user cannot replace the performance data during the automatic performance, and the user can replace the performance data only when the automatic performance is not performed. Thus, it is difficult for the user to image how a song will be performed by the updated performance data. Accordingly, the user should repeat the editing of the performance data and listen to the song performed based on the performance data many times until the desired song is performed.

SUMMARY OF THE INVENTION

In consideration of the above, it is an object of the present invention to provide an automatic performance data editing device which is capable of updating the performance data in memory in a real time manner. The automatic performance data edit device according to the present invention comprises a memory device for storing performance data used for carrying out automatic performance, the performance data including control data which control the automatic performance; an input device for entering a control data; and a control device for editing the performance data stored in the memory in such a manner that when a control data is entered through the operation of the input device after a control data has been read out from the memory device to control the automatic performance, the control data stored in the memory device and read out is updated by the entered control data.

Further objects and advantages of the present invention will be understood from the following description of the preferred embodiments with reference to the drawing.

DETAILED DESCRIPTION OF THE PREFERRED EMBODIMENTS

Figure 1:
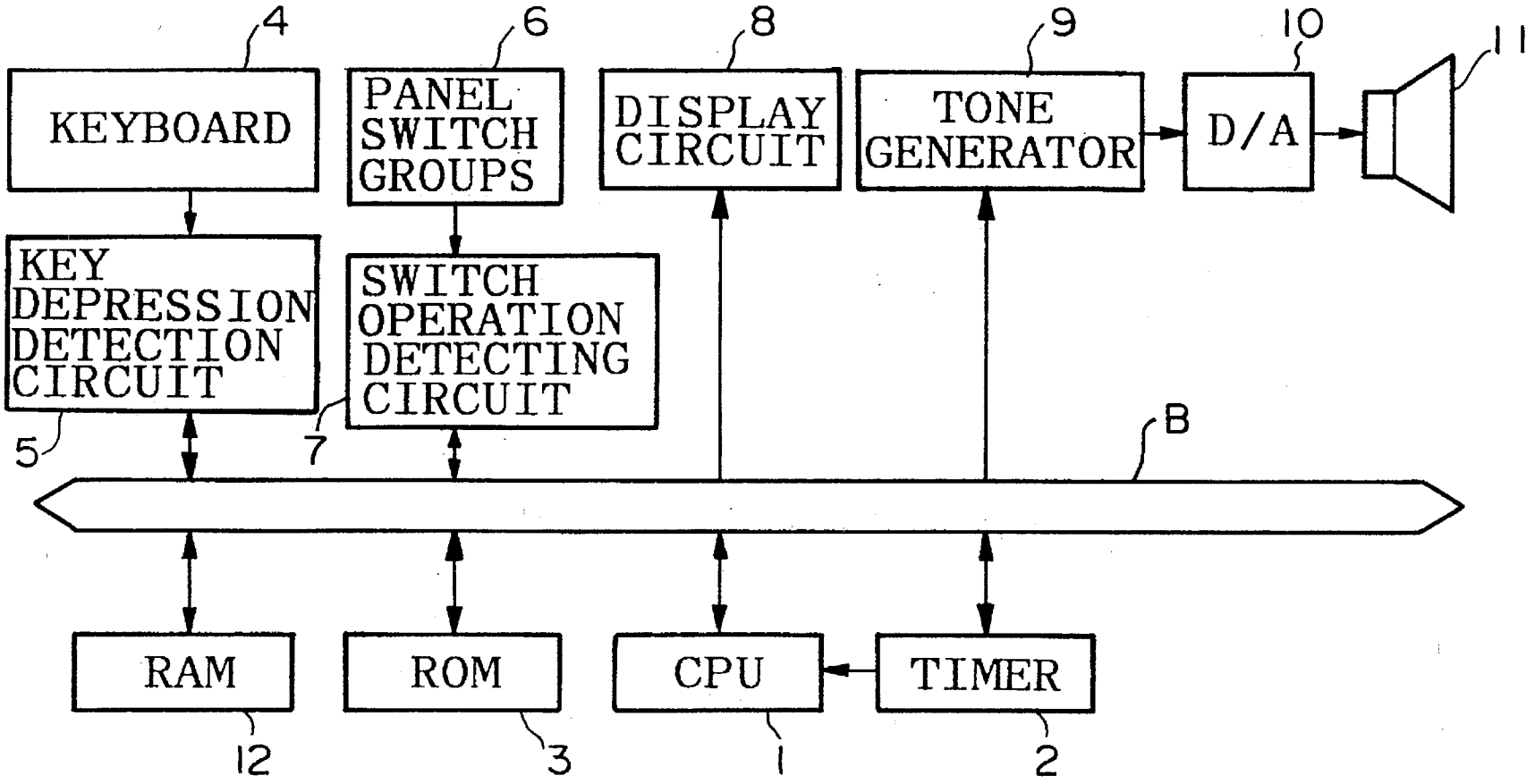
FIG. 1 is a block diagram showing the configuration of the automatic performance data editing device of a preferred embodiment of the present invention.

FIG. 1 is a block diagram showing the configuration of an automatic performance data editing device of a preferred embodiment of the present invention. In FIG. 1, 1 designates a CPU (Central Processing Unit) for controlling the operation of the device. CPU 1 communicates to the other elements of the device via bus B. 2 designates a timer which periodically generates and supplies a timer interrupt signal to CPU 1 by a predetermined period. 3 designates a ROM (Read Only Memory) which stores control programs to be executed by CPU 1. 4 designates a keyboard having a plurality of keys. 5 designates a key operation detecting circuit which detects a depressing or a releasing operation applied to each key on the keyboard. The detected operations are thereby input to CPU 1 as key-on events or key-off events. 6 designates a panel switch group consisting of panel switches provided on a control panel (not shown) of the device. The ON/OFF statuses of these panel switches are detected by switch operation detecting circuit 7. The detected ON/OFF statuses are thereby input to CPU 1 as panel switch events.

Figure 2:
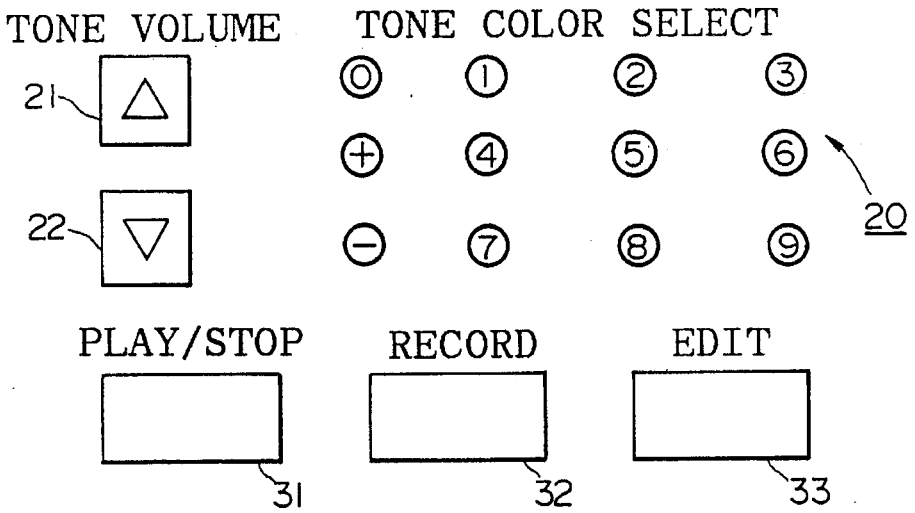
FIG. 2 is a plane view diagram showing panel switches provided on the control panel of the automatic performance data editing device shown in FIG. 1.

FIG. 2 shows important panel switches which are provided on the control panel. In FIG. 2, 20 designates a tone color select section consisting of a + key, a − key and ten keys. Up key 21 and down key 22 are provided for setting the tone volume. Up key 21 is depressed when increasing the tone volume. Down key 22 is depressed when decreasing the tone volume. Play/stop switch 31 is operated when starting or stopping the automatic performance. Record switch 32 is operated when starting the recording of performance data. Edit switch 33 is depressed when updating the previous recorded automatic performance data.

In FIG. 1, 8 designates a display circuit. 9 designates a tone generator which generates digital musical tone signals. The digital musical tone signals are converted to analog signals. The converted analog signals are supplied to sound system 11 and thereby output as musical tones. 12 designates a RAM (Random Access Memory) having a plurality of storage areas. Automatic performance data are stored in the predetermined areas of these storage areas.

Figure 3:
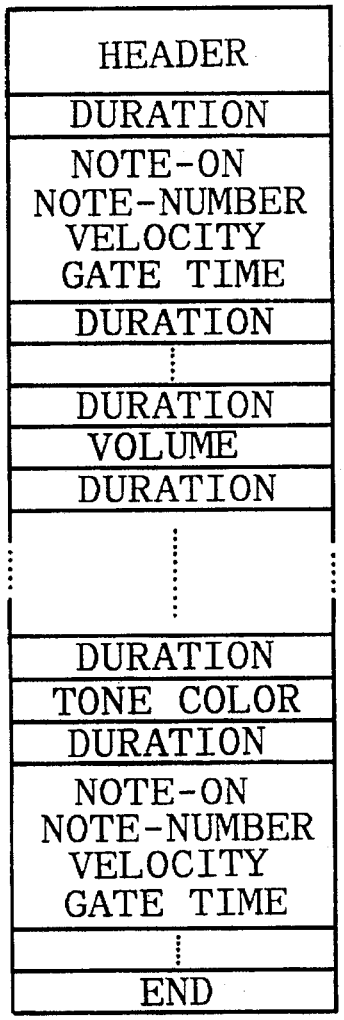
FIG. 3 shows the format of performance data stored in a RAM employed in the automatic performance data editing device shown in FIG. 1.

FIG. 3 shows the format of performance data stored in RAM 12. In the head area of the performance data storage areas in RAM 12, a header is stored. This header includes information used for initializing the tone color, the tone volume, the tempo of the song, and the octave. In the storage areas following the head area, duration data and event data, which are basically coupled, are sequentially stored.

Event data are such control data for controlling musical tone generation as note data, tone color data and volume data. A note data includes:

(a) a note-on data which triggers the musical tone generation;

(b) a note-number data which designates the note number of a musical tone to be generated;

(c) a velocity data which designates the intensity of the musical tone; and (d) a gate-time data which designates a time interval in which the musical tone generation should be maintained.

A tone color data designates the tone color of the musical tone to be generated and Includes therein a tone color number consisting of one of the values from [0] to [99]. A volume data designates the tone volume of the musical tone to be generated and Includes therein a volume value consisting of one of the values from [0] to [125].

A duration data designates an interval time which is to be lapsed since the last event data prior to the duration data has be used for the control of the musical tone generation until the event data following the duration data is used for the control. After all of event data and duration data, an end data follows. This end data indicates the end of the performance data.

The other storage areas of RAM 12 are used as registers and flags for control. Important registers and flags are given as follows:

Tempo clock register TC: The content of tempo clock register TC is incremented when the timer interrupt signal is generated.

Tone color number register TONE: Tone color number register TONE stores a tone color number which designates the tone color of the generated musical tone.

Volume value register VOL: Volume value register stores a volume value which is to be applied to the volume of the generated musical tone.

Tone color change event flag TNEV: This flag is set when a new tone color is set.

Volume change event flag VLEV: This flag is set when a new volume value is set.

Record flag REC: When this flag is set, the function mode of the device is changed to a record mode in which automatic performance data are recorded in RAM 12.

Edit flag EDIT: When this flag is set, the function mode of the device is changed to an edit mode in which the performance data previously stored in RAM 12 are updated in response to the operation applied by the user.

Run flag RUN: When this flag is set, the automatic performance and the recording of automatic performance data start, whereas when this flag is reset, the automatic performance and the recording of the automatic performance data end.

Record wait flag RWAIT: When this flag is set, the changing to the recording mode is enabled.

Edit wait flag EWAIT: When this flag is set, the changing to edit mode is enabled.

Timing register TIME: The content of this register is incremented following the generation of the timer interrupt signal. The content is used for recognizing the lapse time.

Duration register DUR: This register is used for storing duration data.

Tone color change position address register TNADRS: When a tone color data Is read out from one of the performance data storage areas in RAM 12, the address of the storage area is written in this register.

Volume change position address register VLADRS: When a volume data is read out from one of the performance data storage areas in RAM 12, the address of the storage area is written in this register.

Hereinafter, a description will be given with respect to the operations of this automatic performance data editing device. This device has the following four modes, each of which is set when the flags relating to the mode are set into the statuses indicated in parenthesis:

(1) Musical instrument mode (REC="0", EDIT="0", RUN="0")

(2) Recording mode (RUN="1", REC="1")

(3) Automatic performance mode (RUN="1", REC="0", EDIT="0")

(4) Edit mode (RUN="1", REC="0", EDIT="1")

Figure 4:
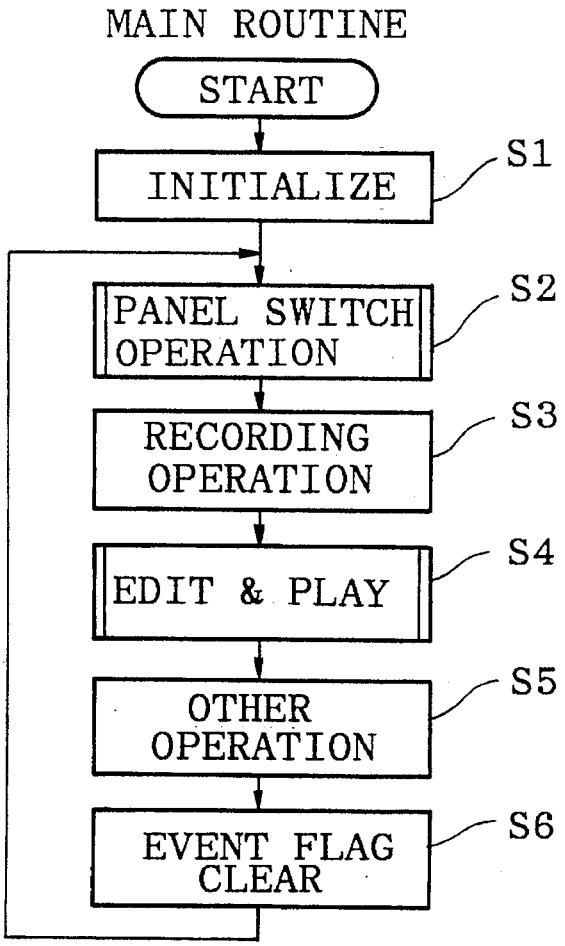
FIGS. 4, 5, 6(*a*), 6(*b*) and 7 through 13 are flow charts showing the operation of the automatic performance data editing device shown in FIG. 1.
Figure 5:
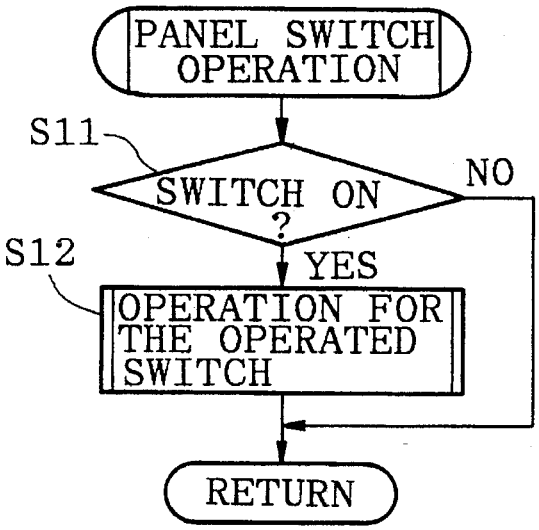
Figure 6:
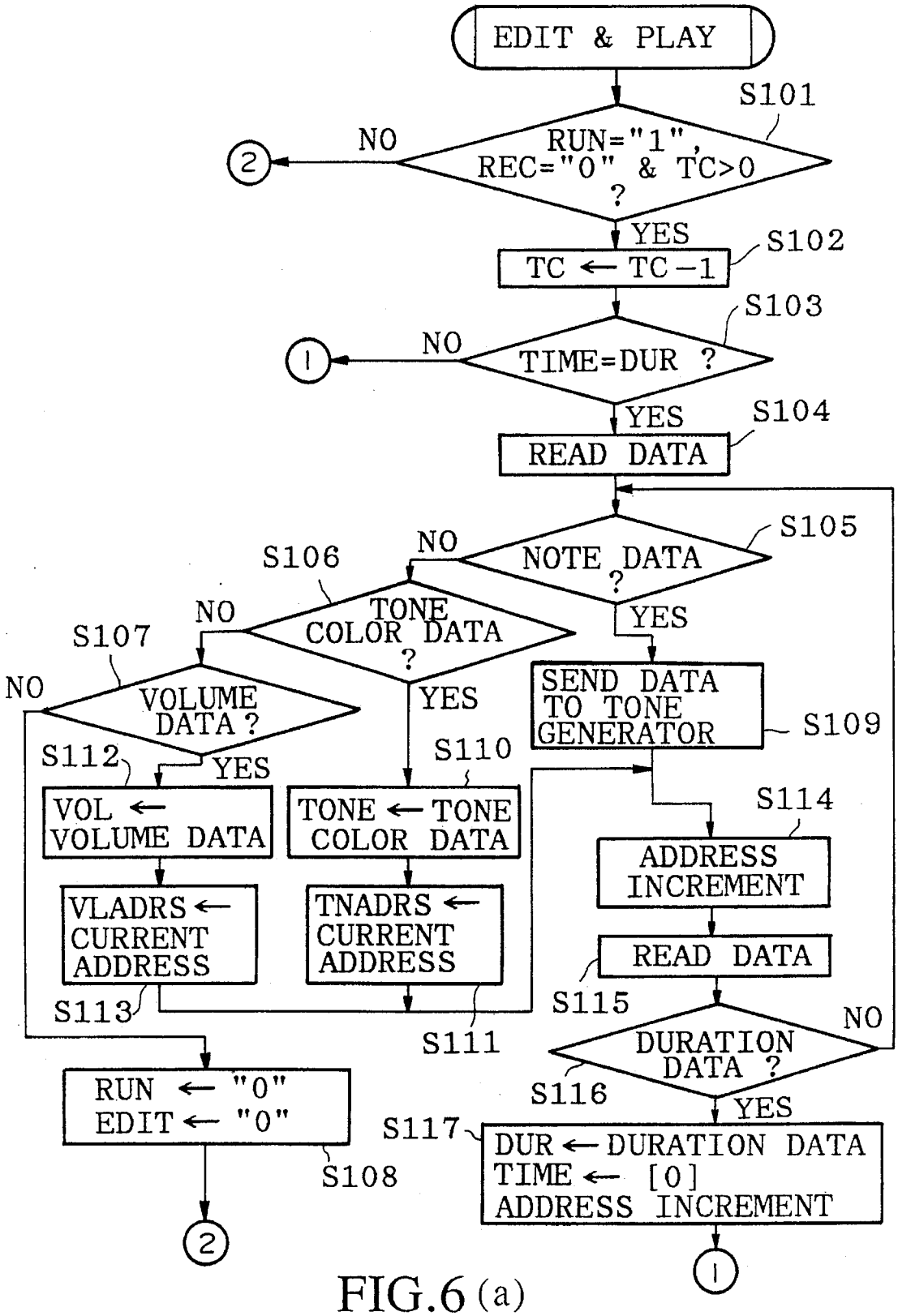
Figure 6B:
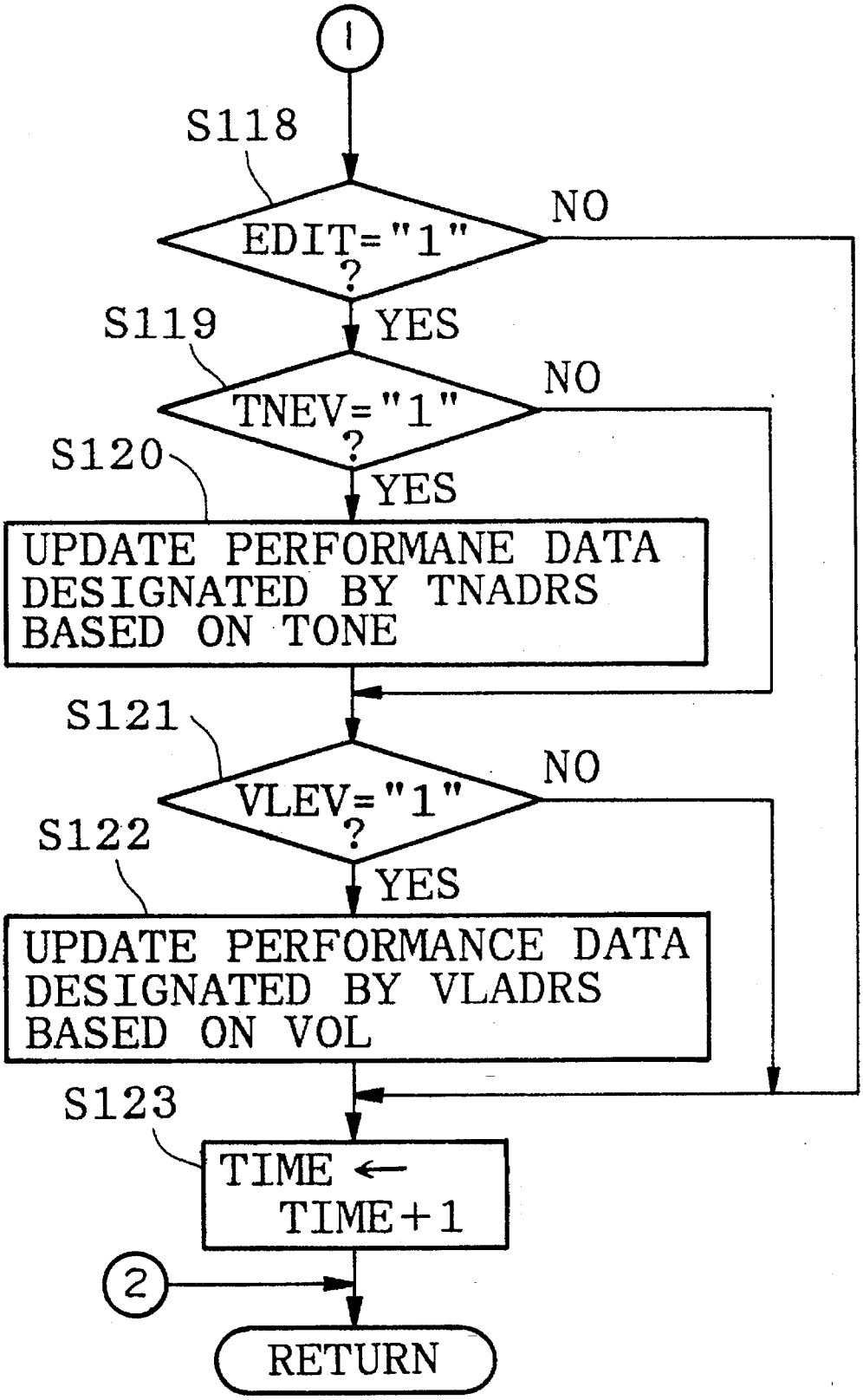
Figure 7:
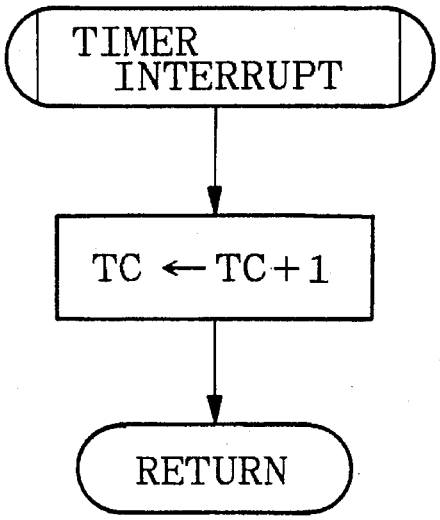

When the power switch (not shown) of this device is changed into an on-state and the electric power of the power supply (not shown) is supplied to the elements of the device, CPU 1 starts to execute the main routine, the flow chart of which is shown in FIG. 4. First, the routine proceeds to step S1 wherein a initialization operation is carried out. As a result, initial values are written in registers and flags which are the storage areas of RAM 12, and the function mode of the device is thereby set to the musical instrument mode. Next, the routine proceeds to step S2, the panel switch operation routine, the flow chart of which is shown in FIG. 5, is called. In step S11 of the panel switch operation routine, a judgement is made as to whether any panel switch has been depressed or not. When the result of this judgement is [YES], the routine proceeds to step S12. In step S12, the subroutine corresponding to the depressed panel switch is executed. The routine then returns to the main routine. In contrast, when the result of the judgement in step S11 is [NO], the routine directly returns to the main routine without the execution of step S12. When the routine returns to the main routine from the panel switch operation routine, the routine proceeds to step S3. In step S3, if the function mode is the recording mode and any event such as a key-on event, key-off event, tone color setting event or volume setting event is detected, the detected event is written in RAM 12 as the automatic performance data. Next, the routine proceeds to step S4, wherein the edit operation routine, the flow charts of which are shown in FIGS. 6(*a*) and 6(*b*), is executed. First in step S101 of the edit and play routine, a judgement is made as to whether RUN="1", REC="0" and TC are greater than [0] or not. When the result of this judgement is [YES], the routine proceeds to step S102, whereas when the result of the judgement is [NO], the routine returns to the main routine. When the routine returns to the main routine from the edit and play routine, the routine proceeds to step S5. In step S5, CPU 1 executes the other operations relating to the function of a general electronic musical instrument such as operations for musical tone generation in response to the key operation applied to keyboard 4. Next in step S6, CPU 1 clears event flags which have been previously set in response to the detection of the operational events of the control panel and of the key-on or key-off event of keyboard 4. After the completion of step S6, the routine returns to step S2. Thereafter, steps S2 through S6 are repeatedly executed as described above. On the other hand, when the timer interrupt signal is generated, CPU 1 interrupts the current operation and executes the timer interrupt routine, the flow chart of which is shown in FIG. 7, to increment the content of tempo clock register TC.

<Tone color setting operation and volume setting operation>

Figure 8:
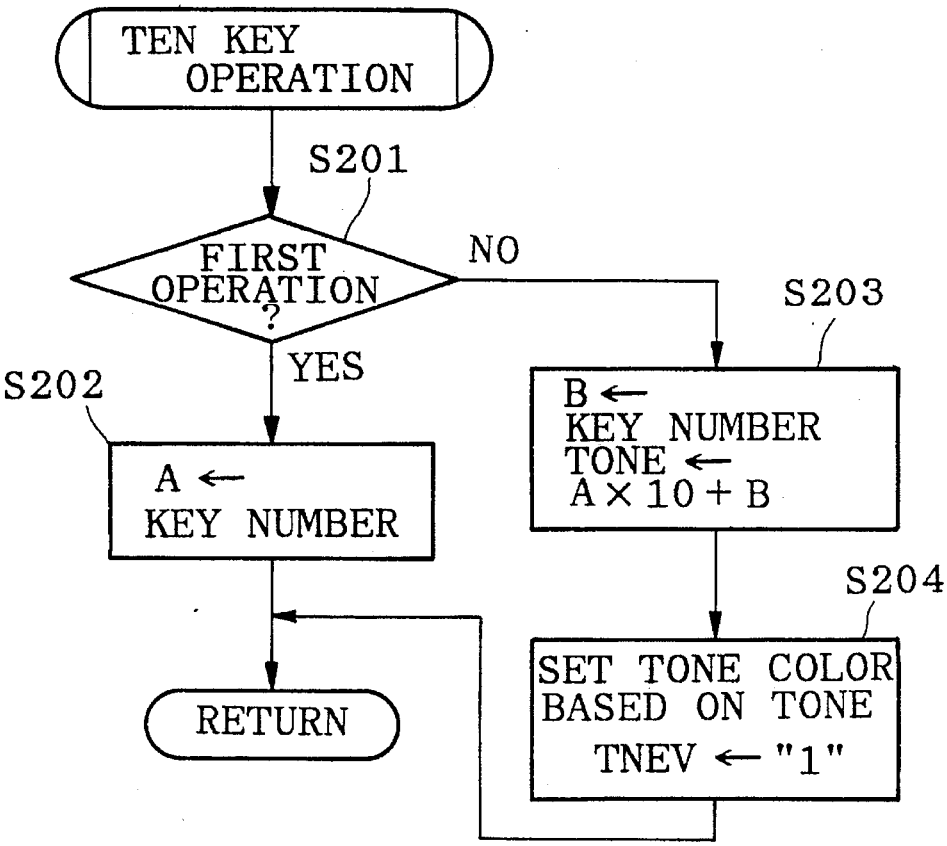

The user can set a desired tone color by depressing the + key, – key or ten keys in tone color select section 20. First, the user depresses one of the ten keys to input the value of the ten's place of the desired tone color number. As a result, the routine proceeds to step S11 of the panel switch routine via step S2 of the main routine and the result of the judgement in step S11 is [YES]. The routine thereby proceeds to step S12, wherein the ten keys operation routine, the flow chart of which is shown in FIG. 8, is executed. In step S201 of the ten keys operation routine, a judgement is made as to whether the ten keys operation is the first operation or not. In this case, the result of this judgement is [YES], and the routine thereby proceeds to step S202 to write the input value in register A. The routine then returns to the main routine via the panel switch operation routine. When the user depresses one of the ten keys to input the value of the unit's place of the desired tone color number, the ten keys operation routine is executed again. In this case, the result of the judgement in step S201 is [NO]. As a result, the routine proceeds to step S203. In step S203, the input value is written in register B, after which the calculation of A*10+B ("*" indicates multiplication) is executed and the result of the calculation is stored in tone color number register TONE. Next in step S204, tone color parameters of the tone color designated by TONE are set to tone generator 9 and "1" is set to tone color change event flag TNEV. The routine then returns to the main routine via the panel switch operation routine.

Figure 9:
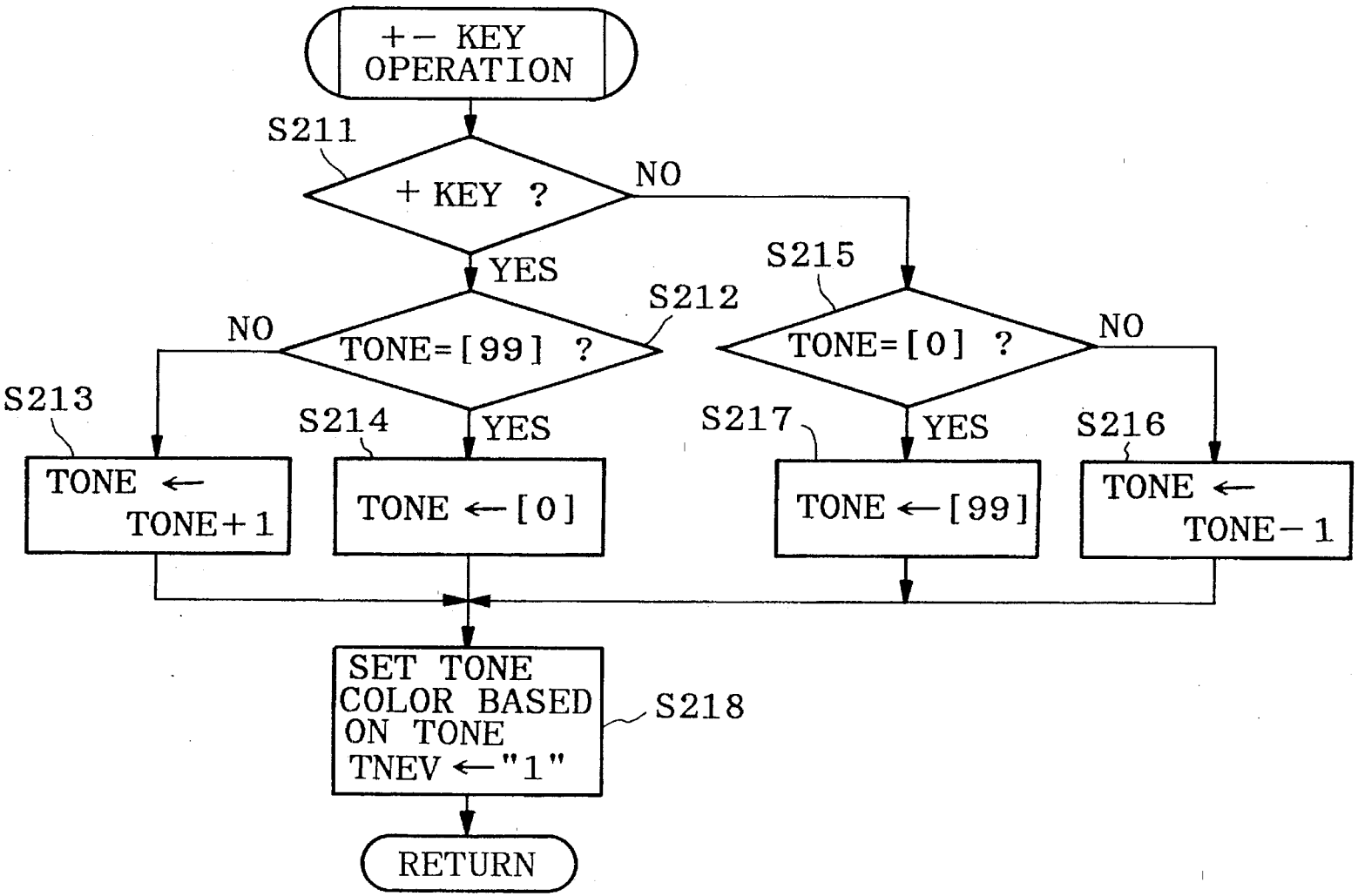

When increasing or decreasing the tone color number of the generated musical tone, the user depresses the + key or the – key. As a result, the routine proceeds to the ± key operation routine, the flow chart of which is shown in FIG. 9, via step S12 of the panel switch operation routine. In step S211, a judgement is made as to whether the + key has been depressed or not. When the result of this judgement is [YES], the routine proceeds to step S212. In step S212, a judgement is made as to whether the content of tone color number register TONE is [99] or not. When the result of this judgement is [NO], the content of the tone color number register TONE is incremented (step S213) and the routine then proceeds to step S218, whereas when the result of the judgement is [YES], [0] is set to tone color number register TONE (step S214) and the routine proceeds to step S218. When the user depresses the –key, the result of the judgement in step S211 is [NO]. As a result, the routine proceeds to step S215. In step S215, a judgement is made as to whether the content of the tone color number register TONE is [0] or not. When the result of this judgement is [NO], the content of tone color number register TONE is decreased (step S216) and the routine then proceeds to step S218, whereas when the result of the judgement is [YES], [99] is set to tone color number register TONE (step S217) and the routine proceeds to step S218. Next in step S218, tone color parameters of the tone color designated by TONE are set to tone generator 9 and "1" is set to tone color change event flag TNEV. The routine then returns to the main routine via the panel switch operation routine.

Figure 10:
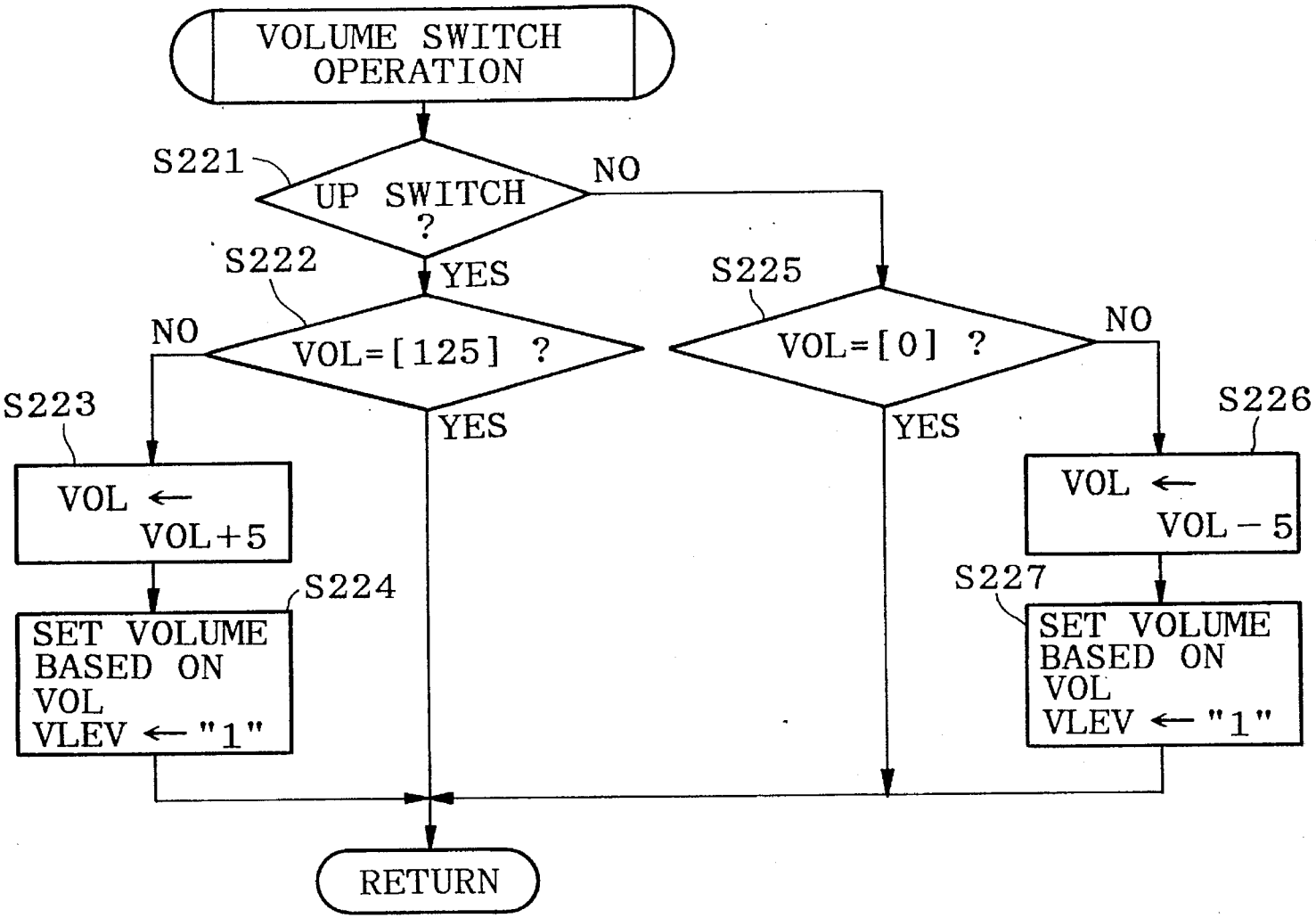

Next, a description will be given with respect to the volume setting of this device. When the user depresses up switch 21 or down switch 22 in order to change the tone volume, the routine proceeds to the volume switch operation routine, the flow chart of which is shown in FIG. 10, via step S12 of the panel switch operation routine. In step S221 of the volume switch operation routine, a judgement is made as to whether up switch 21 has been depressed or not. When the result of this judgement is [YES], the routine proceeds to step S222 wherein a judgement is made as to whether the current value of volume value register VOL is [125] or not. When the result of this judgement is [YES], the routine returns to the main routine via the panel switch operation routine. When the result of this judgement is [NO], the content of volume value register VOL is incremented by [5] (step S223), after which the tone volume of tone generator 9 is set to the value designated by VOL and "1" is set to volume change event flag VLEV (step S224). The routine then returns to the main routine via the panel switch operation routine. In contrast, when the user depresses down switch 22, the result of the judgement in step S221 is [YES]. As a result, the routine proceeds to step S225. In step S225 a judgement is made as to whether the current value of volume value register VOL is [0] or not. When the result of the judgement in step S226 is [YES], the routine returns to the main routine via the panel switch operation routine. When the result of this judgement is [NO], the content of volume value register VOL is decreased by [5] (step S226), after which the tone volume of tone generator 9 is set to the value designated by VOL and "1" is set to volume change event flag VLEV (step S227). The routine then returns to the main routine via the panel switch operation routine.

<Mode Setting>

While the function mode of this device is the musical instrument mode or automatic performance mode which satisfies the condition of REC="0" and EDIT="0", the user can determine the function mode which is to be set as the function mode of the device next time by depressing record switch 32 or edit switch 33.

Figure 11:
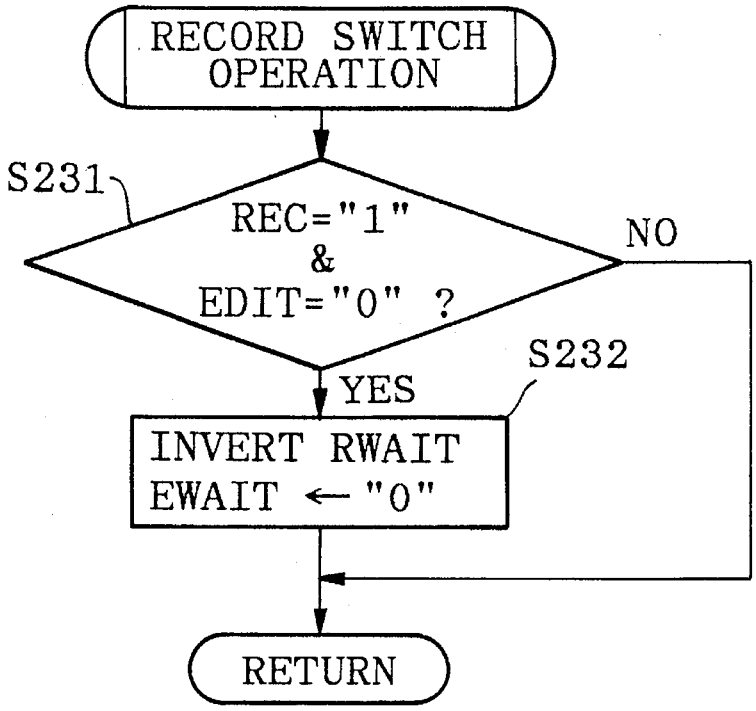

When the user depresses record switch 32, the routine proceeds to the record switch operation routine, the flow chart of which is shown in FIG. 11, via step S12 of the panel switch operation routine. In step S231 of the record switch operation routine, a judgement is made as to whether the contents of record flag REC and edit flag EDIT are all "0" or not. When the result of this judgement is [YES], the routine proceeds to step S232. In step S232, the content of record wait flag RWAIT is inverted and "0" is written in edit wait flag EWAIT. The routine then returns to the main routine via the panel switch operation routine. On the other hand, when the user depresses record switch 32 in the record mode or the edit mode, such a depressing operation is ignored so that the result of the judgement in step S231 is [NO] and the routine returns to the main routine via the panel switch operation routine.

Figure 12:
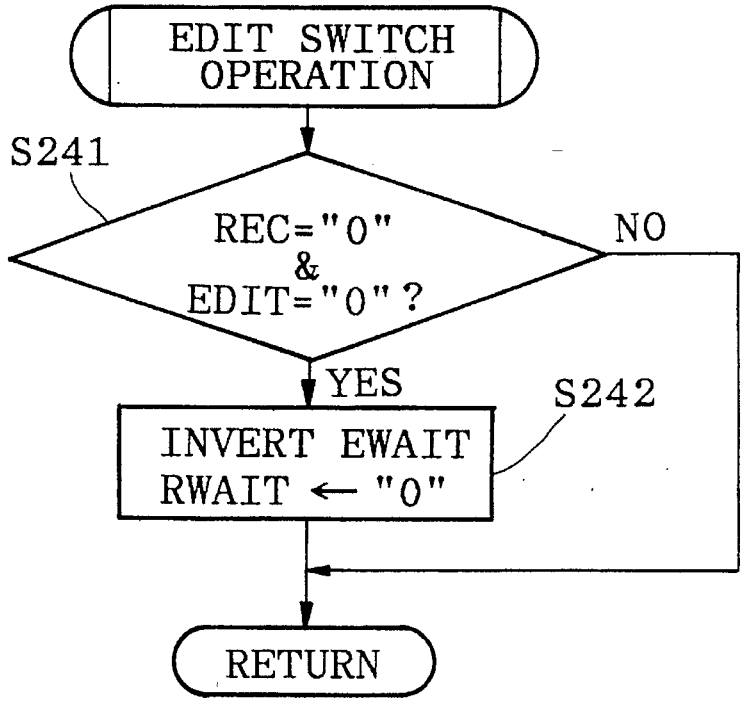

When the user depresses edit switch 33, the routine proceeds to the edit switch operation routine, the flow chart of which is shown is FIG. 12, via step S12 of the panel switch operation routine. In step S241 of the edit switch operation routine, a judgement is made as to whether the contents of record flag REC and edit flag EDIT are all "0" or not. When the result of this judgement is [YES], the routine proceeds to step S242. In step S242, the content of edit wait flag EWAIT is inverted and "0" is written in record wait flag RWAIT. The routine then returns to the main routine via the panel switch operation routine. On the other hand, when the user depresses edit switch 33 in the recording mode or the edit mode, such a depressing operation is ignored so that the result of the judgement in step S241 is [NO] and the routine returns to the main routine via the panel switch operation routine.

The contents of record wait flag RWAIT and edit wait flag EWAIT are indicated by indicators such as LEDs. The user can recognize the function mode of this device by the indication of the LEDs and can set the desired values to record wait flag RWAIT and edit wait flag EWAIT by depressing record switch 32 or edit switch 33 based on the recognized function mode.

Figure 13:
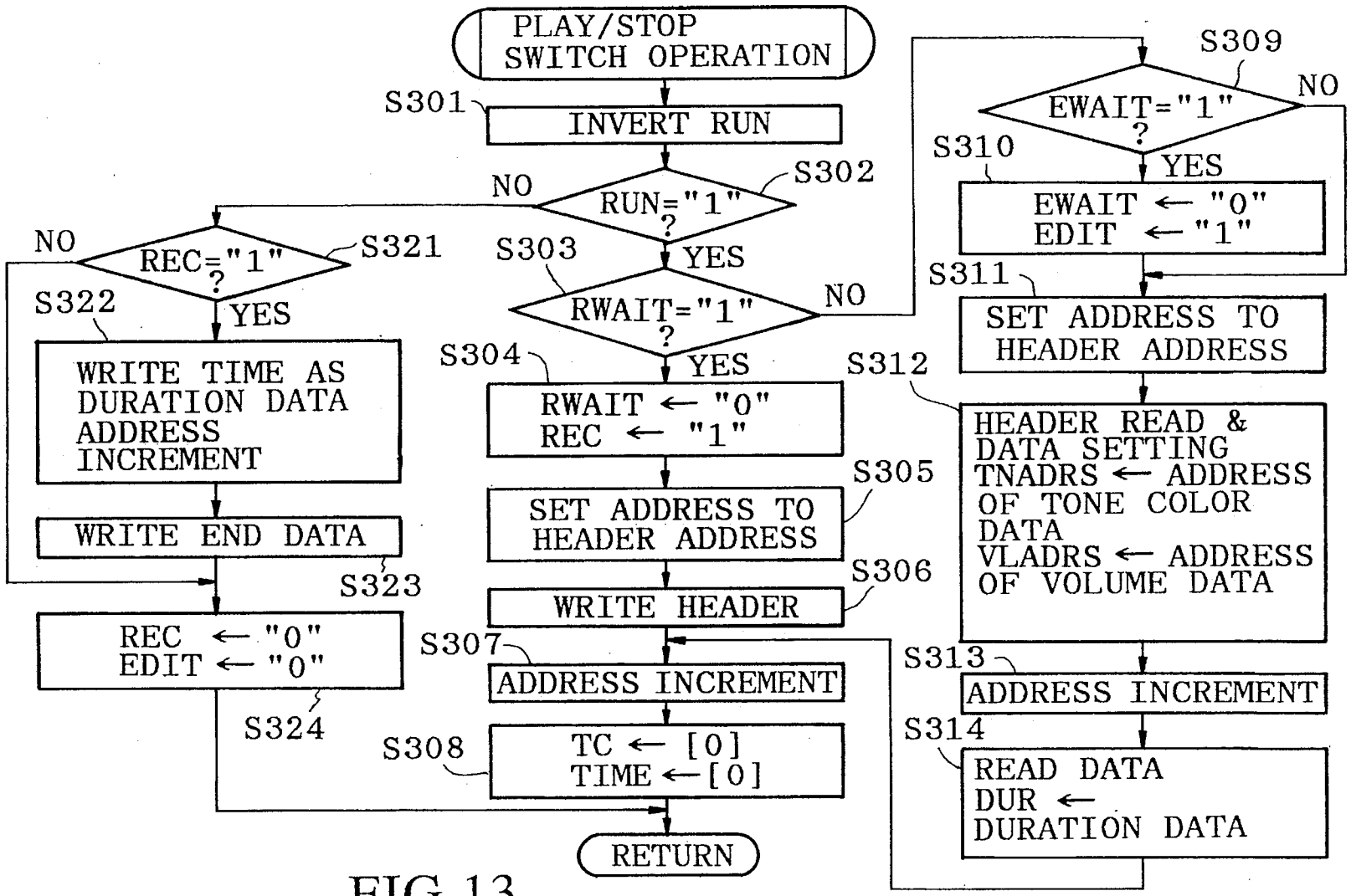

When the user depresses play/stop switch 31, the routine then proceeds to the play/stop switch operation routine, the flow chart of which is shown in FIG. 13, via step S12 of the panel switch operation routine. In step S301 of the play/stop switch operation routine, the content of run flag RUN is inverted. Next in step S302, a judgement is made as to whether the content of run flag RUN is "1" or not. When the result of this judgement is [YES], the routine proceeds to step S303, whereas when the result of the judgement is [NO], the routine proceeds to step S321. In step S303, a judgement is made as to whether the content of record wait flag RWAIT is "1" or not.

In the case where "1" has be already stored in record wait flag RWAIT by the depression of record switch 32, the result of the judgement in step S303 is [YES]. As a result, the routine proceeds to step S304. In step S304, "0" is written in record wait flag RWAIT and "1" is written in record flag REC. Next in step S305, the address of RAM 12 is set to the head address of the performance data storage area. Next in step S306, header data including a tone color number and a volume value, which are currently determined based on the on/off status of the corresponding switches on the control panel, are written in the head area of the performance data storage areas. Next in step S307, the address of RAM 12 is incremented. Next in step S308, [0] is stored in tempo clock register TC and in timing register TIME. The routine then returns to the main routine via the panel switch operation routine. In this manner, record flag REC is set and the function mode of this device is set to the recording mode, in the case when the user depresses record switch 32 to set record wait flag RWAIT after which the user depresses play/stop switch 31 to set run flag RUN.

When the result of the judgement in step S303 is [NO], the routine proceeds to step S309. In step S309, a judgement is made as to whether the content of edit wait flag EWAIT is "1" or not. In the case where "1" has been already stored in edit wait flag EWAIT by the depression of edit switch 33, the result of the judgement In step S309 is [YES]. As a result, the routine proceeds to step S310. In step S310, "0" is written in edit wait flag EWAIT and "1" is written in edit flag EDIT. Next in step S311, the address of RAM 12 is set to the head address of the performance data storage areas. Next in step S312, the header data including the initial tone color number and the initial volume value are read out from the head area of the performance data storage areas. The address of the area which has stored the tone color data is then written in tone color change position address register TNADRS and the address of the area which has stored the volume data is written in volume change position address register VLADRS. Next in step S313, the address of RAM 12 is incremented. Next in step S314, the first duration data is read out from the area corresponding to the address and this read-out duration data is then written in duration register DUR. Next, the routine proceeds to step S307 wherein the address of RAM is incremented. Next in step S308, [0] is written in tempo clock register TC and in timing register TIME. After the completion of step S308, the routine returns to the main routine via the panel switch operation routine. In this manner, edit flag EDIT is set and the function mode of this device is set to the edit mode, in the case when the user depresses edit switch 33 to set edit wait flag EWAIT after which the user depresses play/stop switch 31 to set run flag RUN.

When the user depresses play/stop switch 31 in the condition of RWAIT="0" and EWAIT="0", the routine returns to the main routine via steps S302, S303, S309, S311–S314, S307 and S308 if "1" is written in run flag RUN in step S301. In this manner, the automatic performance mode is set.

<Musical Instrument mode>

In this function mode, when the user operates the appropriate switches to set the tone volume or the tone color, the routine corresponding to the operated switch is executed in step S12 of the panel switch operation routine and the performance control responding to the operated switch is carried out through the execution of the routine. Furthermore, when the user operates the keys on the keyboard, the key-on events or key-off events are detected and the performance control is carried out based on the detected event in step S5 of the main routine.

<Recording mode>

The function mode of this device is set to the recording mode by setting record wait flag RWAIT and then setting record flag REC. In the recording mode (RUN="1" and REC="1"), when any performance events such as key-on events, tone color setting events or tone volume setting events are detected, the detected events are written in RAM 12 as performance data in step S3 of the main routine. Furthermore, when the user depresses play/stop switch 31 in the recording mode, the play/stop switch operation routine is executed and "0" is thereby written in run flag RUN in step S301 of the routine. The routine then proceeds to step S321 via step S302. In step S321, a judgement is made as to whether the content of record flag REC is "1" or not. In this case, the result of this judgement is [YES]. Therefore, the routine proceeds to step S322. In step S322, the data currently stored in timing register TIME is read out and this read out data is written in RAM 12 as duration data, after which the address of RAM 12 is incremented. Next in step S323, an end data indicating the end of the performance data is written in RAM 12. Next in step S324, record flag REC and edit flag EDIT are reset. The routine then returns to the main routine. As a result, the recording mode is reset.

<Automatic performance mode>

Next, the description will be given with respect to the operation of the automatic performance mode (RUN="1", REC="0", EDIT="0"). When the edit and play routine is executed in step S4 of the main routine, a judgement is made in step S101 of the edit and play routine as to whether RUN="1", REC="0" and the content of tempo clock register TC is greater than [0] or not. When the content of tempo clock register TC becomes greater the [0] by the execution of the timer interrupt routine, the result of this judgement becomes [YES] because RUN="1" and REC="0" in this mode. As a result, the routine proceeds to step S102. In step S102, the content of tempo clock register TC is decreased by one. Next in step S103, a judgement is made as to whether the content of timing register TIME equals the content of duration register DUR or not, i.e., the interval designated by the first duration data has elapsed or not since the function mode has been set to the automatic performance mode. When the result of this judgement is [NO], the routine proceeds to step S118, wherein a judgement is made as to whether the content of edit flag EDIT is "1" or not. In this case, the result of this judgement is [NO]. Therefore, the routine proceeds to step S123. In step S123, the content of timing register TIME is incremented. The routine then returns to the main routine.

On the other hand, the timer Interrupt routine is executed and the content of timing register TC is thereby incremented every time the timer interrupt signal is generated. When the edit and play routine is executed after the content of timing register TC becomes greater than 0, the result of the judgement in step S101 becomes [YES]. As a result, step S102 and subsequent steps are executed, after which step S123 is executed to increment the content of timing register TIME. In this manner, the content of timing register TIME is incremented nearly In synchronization with the generation of the timer interrupt signal. When the content of timing register TIME equals to the content of duration register DUR, the result of judgement in step S103 of the edit and play routine is [YES]. As a result, the routine proceeds to step S104. In step S104, the performance data is read out from RAM 13. Next in step S105, a judgement is made as to whether the read out performance data is a note data or not. When the result of this judgement is [YES], the read out note data is sent to tone generator 9 to generate the musical tone (step S109), after which the routine proceeds to step S114. When the result of the judgement in step S105 is [NO], the routine proceeds to step S106. In step S106, a judgement is made as to whether the read out performance data is a tone color data or not. When the result of this judgement is [YES], the routine proceeds to step S110. In step S110, the read out tone color data is written in tone color number register TONE. Next in step S111, the address currently applied to RAM 12, i.e., the address of the area from which the above tone color data has been read out is written in tone color change position address register TNADRS. The routine then proceeds to step S114. When the result of the judgement in step S106 is [NO], the routine proceeds to step S107. In step S107, a judgement is made as to whether the read out performance data is a volume data or not. When the result of this judgement is [YES], the routine proceeds to step S112, wherein the read out volume data is written in volume register VOL. Next in step S113, the address currently applied to RAM 12, i.e., the address of the area from which the above volume data has been read out is written in volume change position address register VLADRS. The routine then proceeds to step S114. When the result of the judgement in step S107 is [NO], such a result indicates that the read out performance data is an end data. In this case, the routine proceeds to step S108 wherein run flag RUN and edit flag EDIT are reset, after which the routine returns to the main routine. As a result, the automatic performance mode is reset.

When the routine proceeds to step S114, the address applied to RAM 12 is incremented. Next in step S115, the performance data is read out from the area of RAM 12 corresponding to the address. Next in step S116, a judgement is made as to whether the read out data is a duration data or not. When the result of this judgement is [NO], the routine returns to step S105. As a result, the certain operation is determined and executed based on the judgement in which the type of the read out performance data is judged as a note data, a tone color data or a volume data, as described above. In contrast, when the result of the judgement in step S116 is [YES], the routine proceeds to step S117. In step S117, the read out duration data is written in duration register DUR; [0] is written in timing register TIME; and the address applied to RAM 12 is incremented. The routine then proceeds to step S123 via step S118. In step S123, the content of timing register TIME is incremented. The routine then returns to the main routine. Thereafter, the content of timing register TIME is increased by the execution of the edit and play routine. When the edit and play routine is executed, after the content of timing register TIME has been increased to equal the content of duration register DUR, step S104 is executed and the new performance data is thereby read out following which the performance control corresponding to this read out data is carried out.

When the user depresses play/stop switch 31 in the automatic performance mode, the play/stop switch operation routine is thereby executed. In this case, "0" is written in run flag in step S301. The routine then proceeds to step S321 via step S302. In step S302, a judgement is made as to whether the content of record flag REC is "1" or not. In this case, the result of this judgement is [NO]. Therefore, the routine proceeds to step S324 to reset record flag REC and edit flag EDIT. The routine then returns to the main routine. As a result, the automatic performance mode is reset.

<Edit mode>

Next, the description will be given with respect to the operation of the edit mode (RUN="1", REC="0", EDIT="1"). In the edit mode, when the routine proceeds to step S118 of the edit and play routine, the result of judgement in step S118 is [YES] because EDIT="1". As a result, step S119 through S122 are executed, after which step S123 is executed. Prior to the proceeding to step S119, if TIME=DUR, the operations of step S104 through step S117 are executed which have been previously described and the operations are same as that of the automatic performance mode. Through the execution of these steps, the performance data is read out from RAM 12 and the performance control corresponding to the read out data is carried out whereby an automatic performance is performed. After such a procedure for automatic performance is executed, the routine proceeds to step S119 via step S103 or via S117 and via S118. In step S119, a judgement is made as to whether the content of tone color change event flag TNEV is "1" or not. When the result of this judgement is [YES], the routine proceeds to step S120, whereas when the result of the judgement is [NO], the routine proceeds to step S123 to increment the content of timing register TIME, after which the routine returns to the main routine.

When the user operates the switches on tone color select section 20 while the automatic performance is being performed, a certain routine corresponding to the operated switch such as the ten keys switch operation routine or the ± key operation routine is executed via the panel switch operation routine. As a result, the desired tone color number entered by the above switch operation is written in tone color number register TONE and "1" is written in tone color change event flag TNEV. As a result, the result of the judgement in step S119 becomes [YES]. The routine thereby proceeds to step S120. In step S120, the tone color number is read out from tone color number register TONE and tone color data constituted by the read out tone color number is written in the area of RAM 12 which is designated by tone color change position address register TNADRS. The routine then proceeds to step S121.

In this manner, when the desired tone color number is entered by the user, while a tone color data immediate previously read out from RAM 12 is active and the read out tone color data is being used for the tone generation, the tone color data in RAM 12, which has be thus read out and used, is replaced by the entered tone color number.

For example, suppose that the automatic performance is controlled based on the performance data and the tone color thereby varies in response to the tone color data included in the read out performance data as follows:

(1) Tone color data A is read out and used at the start of the automatic performance.

(2) Next, tone color data B is read out and used at time $t_1$.

(3) Next, tone color data C is read out and used at time $t_2$.

Figure 14A:
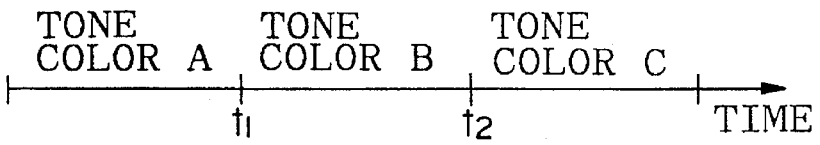
FIGS. 14(*a*), 14(*b*), (*c*), 15(*a*), 15(*b*) and 15(*c*) are time charts showing the operation of the automatic performance data editing device shown in FIG. 1.
Figure 14B:
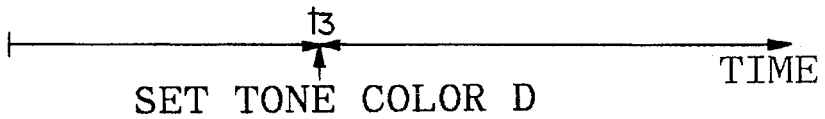
Figure 14C:
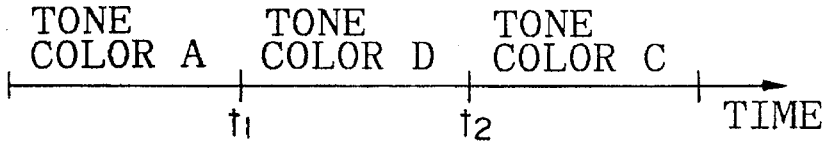

FIG. 14(*a*) shows the above supposed case. In this case, when the user enters tone color data D at time $t_3$, which is prior to time $t_2$, as shown in FIG. 14(*b*), tone color data B in RAM 12 is updated by tone color data D as shown in FIG. 14(*c*).

When the user operates up switch 21 or down switch 22 while the automatic performance is being performed, the volume switch operation routine is executed. As a result, the desired volume value entered by the above switch operation is written in volume value register VOL and "1" is written in volume change event flag VLEV. As a result, the result of the judgement in step S121 of the edit and play routine becomes [YES]. The routine thereby proceeds to step S122. In step S122, the volume value is read out from volume value register VOL and the read out volume value is written in the area of RAM 12 which is designated by volume change position address register VLADRS. The routine then proceeds to step S123.

Figure 15A:
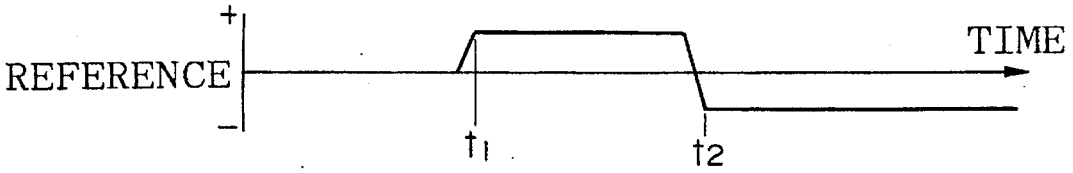
Figure 15B:
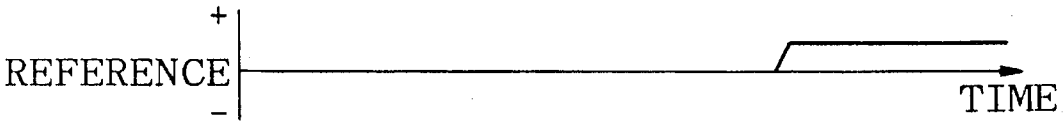
Figure 15C:
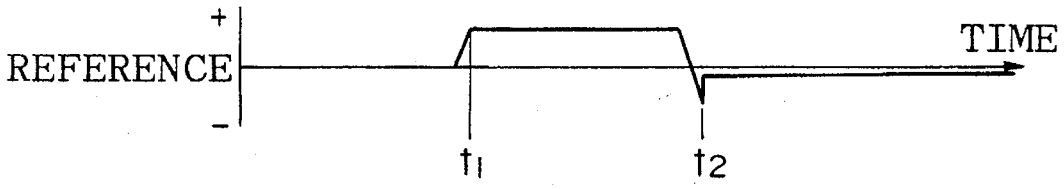

In this manner, when the desired volume value is entered by the user while a volume data Immediate previously read out from RAM 12 is active and the read out volume data is being used for the tone generation, the volume data in RAM 12, which has be thus read out and used, is replaced by the entered volume value. FIGS. 15(*a*), 15(*b*) and 15(*c*) show the example of this volume change operation. FIG. 15(*a*) shows volume data previously stored in RAM 12 and sequentially read out therefrom. FIG. 15(*b*) shows the volume data entered by the user. FIG. 15(*c*) shows the volume data in RAM 12 which are updated by the entered volume data.

When the user depresses play/stop switch 31 in edit mode, "0" is written in run flag RUN in step S301 of the play/stop switch operation routine. The routine then proceeds to step S321 via step S302. In step S321, a judgement Is made as to whether the content of record flag REC is "1" or not. In this case, the result of this judgement Is [NO]. As a result, the routine proceeds to step S324 to reset record flag REC and edit flag EDIT, after which the routine returns to the main routine. As a result, the edit mode is reset.

In the above-described preferred embodiment, tone color data and volume data are updated in response to the operation of the panel switches. However, the application of the present invention is not restricted to just this embodiment. The present invention is applicable to the update of the other performance data such as pitch bend data, effect control data or tempo data. Furthermore, the present invention is applicable to many kinds of performance data edit devices, including chord sequencers and rhythm pattern sequencers.

What is claimed is:

1. An automatic performance data editing device comprising:

memory means for storing performance data used for carrying out automatic performance, the performance data including control data for controlling the automatic performance;

input means for providing control data while carrying out the automatic performance; and control means for editing the performance data stored in the memory means in such a manner that when control data is provided by the input means, control data which has been read out from the memory means to control the automatic performance is updated by the control data provided by the input means, the control means comprising address storage means for storing an address of the control data which has been read out from the memory means, and writing control means for writing the input control data provided by the input means in an area of the memory means designated by the address storage means;

control data which has been read out from the memory means to control the automatic performance being updated by rewriting control data read out from the memory means immediately prior to control data being provided by the input means.

2. An automatic performance data editing device according to claim 1, wherein the control data is a tone color data designating a tone color of musical tones of the automatic performance.

3. An automatic performance data editing device according to claim 1, wherein the control data is a volume data designating a tone volume of the automatic performance.

4. An automatic performance data editing device according to claim 1, wherein the control means edits the performance data stored in the memory means in such a manner that, when control data is provided by the input means after control data stored in the memory means has been read out from said memory means to control the automatic performance, the control data stored in the memory means is updated by the control data provided by the input means.

5. An automatic performance data editing device according to claim 4, wherein the address storage means includes a plurality of storage areas, each of which corresponds to a different type of the control data and stores an address of a corresponding type of the control data which has been previously read out from said memory means, and the writing control means writes the control data provided by the input means in an area of the memory means designated by contents of a storage area of the address storage means which corresponds to a type of the control data provided by the input means.

6. An automatic performance data editing device according to claim 4, wherein the control data includes a tone color data designating a tone color of musical tones of the automatic performance and a volume data designating a tone volume of the automatic performance.

7. An automatic performance data editing device comprising:

memory means for storing performance data used for carrying out automatic performance, the performance data including control data for controlling the automatic performance;

input means for providing control data while carrying out the automatic performance; and control means for editing the performance data stored in the memory means in such a manner that when control data is provided by the input means, control data which has been read out from the memory means to control the automatic performance is updated by the control data provided by the input means, the control means comprising address storage means for storing an address of the control data which has been read out from the memory means, and writing control means for writing the input control data provided by the input means in an area of the memory means designated by the address storage means;

control data which is provided by the input means relating to a performance characteristic and the updated control data relating to the same performance characteristic.

8. An automatic performance data editing device comprising:

memory means for storing performance data used for carrying out automatic performance, the performance data including control data for controlling the automatic performance;

input means for providing control data while carrying out the automatic performance; and control means for editing the performance data stored in the memory means in such a manner that when control data is provided by the input means, control data which has been read out from the memory means to control the automatic performance is updated by the control data provided by the input means, the control means comprising address storage means for storing an address of the control data which has been read out from the memory means, and writing control means for writing the input control data provided by the input means in an area of the memory means designated by the address storage means;

after control data relating to a performance characteristic has been read out from the memory means, such control data continues to be used until different control data relating to the performance characteristic is read out from the memory means.

* * * * *